US005761831A

United States Patent [19]

Cho

[11] Patent Number: 5,761,831

[45] Date of Patent: Jun. 9, 1998

[54] SHOE SOLE HAVING A COLLAPSIBLE CAVITY

[76] Inventor: Myeong-eon Cho, 15-903, Shindonga Apt., Seobinggo-dong, Yongsan-gu, Seoul, Rep. of Korea

[21] Appl. No.: 270,682

[22] Filed: Jul. 5, 1994

[30] Foreign Application Priority Data

Apr. 30, 1994 [KR] Rep. of Korea ..... 94-9557

[51] Int. Cl.[6] ..... A43B 7/32; A43B 5/00; A43B 13/20

[52] U.S. Cl. ..... 36/28; 36/27; 36/29; 36/35 R; 36/35 B

[58] Field of Search ..... 36/28, 29, 35 R, 36/35 B, 27, 30 R

[56] References Cited

U.S. PATENT DOCUMENTS

| | | | |
|---|---|---|---|
| 1,203,898 | 11/1916 | Mussinan | 36/35 B |
| 1,231,777 | 7/1917 | Mussinan | 36/35 B |
| 2,985,971 | 5/1961 | Murawski | 36/35 R |
| 3,180,039 | 4/1965 | Burns, Jr. | 36/29 X |
| 3,608,215 | 9/1971 | Fukoka | 36/29 |
| 4,235,026 | 11/1980 | Plagenhoef | 36/28 X |
| 4,237,625 | 12/1980 | Goue et al. | 36/28 |
| 4,322,891 | 4/1982 | Inohara | 36/29 |
| 4,348,821 | 9/1982 | Daswick | 36/103 |
| 4,521,979 | 6/1985 | Blaser | 36/28 X |
| 4,654,982 | 4/1987 | Lee | 36/3 B X |
| 4,674,200 | 6/1987 | Sing | 36/29 X |
| 4,754,559 | 7/1988 | Cohen | 36/28 X |
| 4,798,009 | 1/1989 | Colonel et al. | 36/28 |
| 5,010,661 | 4/1991 | Chu | 36/3 R X |
| 5,179,792 | 1/1993 | Brantingham | 36/3 B X |
| 5,195,254 | 3/1993 | Tyng | 36/3 B X |
| 5,337,492 | 8/1994 | Anderié et al. | 36/28 |
| 5,367,791 | 11/1994 | Gross et al. | 36/28 X |
| 5,577,334 | 11/1996 | Park | 36/28 |

FOREIGN PATENT DOCUMENTS

| | | | |
|---|---|---|---|
| 1071817 | 9/1954 | France | 36/313 |
| 1265222 | 5/1961 | France | 36/3 B |

*Primary Examiner*—Paul T. Sewell
*Attorney, Agent, or Firm*—Leydig, Voit & Mayer, Ltd.

[57] ABSTRACT

A shoe sole for use in training for improving the muscular strength of the lower extremities when jogging, running or just walking casually, has at least one contractible cavity formed in a heel portion thereof for supporting the heel, and small holes in left and right side walls for communicating with the cavity. The shoe sole promotes walking or running with the wearer's weight positioned forward, and thus, is effective for strengthening the muscles of the lower extremities. Shoes adopting such a shoe sole can be worn safely, since the impact from the ground is alleviated by a cushioning effect according to the contraction of the cavity when the wearer's weight is loaded onto the heel.

16 Claims, 5 Drawing Sheets

SHOE SOLE HAVING A COLLAPSIBLE CAVITY

BACKGROUND OF THE INVENTION

The present invention relates to a shoe sole employed as a bottom structure of shoes, and more particularly, to a shoe sole designed to reinforce the muscular strength of lower extremities of the body when walking, jogging or running.

The muscles of the lower extremities of the human body are the main muscles dominating such movement as running or jumping. Accordingly, physical training for improving the muscular strength of the lower extremities is needed for the general public as well as for athletes. For this reason, people often jog or run, and specifically athletes perform special training exercises for strengthening the lower extremities of the body in addition to jogging or running.

When standing upright with the heels of the bare feet resting on the ground, most of the body weight is loaded onto the rear part of the foot, i.e., the heel. At this time, the center of gravity (balance) of the body is somewhat rearward rather than forward as in the case of sprinting, where the heel is always separated from the ground and the body leans forward. That is, walking or running with the heel lifted is needed for reinforcing the muscular strength of the lower extremities and for obtaining greater agility.

Shoes for ordinary walking are not suitable for jogging or running due to a thick and relatively solid shoe sole. When a wearer jogs or runs with such shoes, it is likely that the wearer would not step forward quickly. In addition, the heel meets the ground first, with rest of the bottom surface touching the ground subsequently, when the wearer continues forward. Thus, more energy is required, which easily tires a person. On the contrary, shoes designed for use in jogging or running have a relatively thin and pliable sole which enables the wearer to easily step forward, lifting the heel.

However, the conventional shoe sole structure for use in jogging or running has not much considered the function for absorbing an impact caused when the heel contacts the ground, and thus, is not suitable for ordinary walk or sport entries other than jogging or running. In addition, the heel is lifted at the state where the entire bottom surface of the shoes touches the ground so that the body balance can be moved to the front. Thus, it takes relatively much labor when moving, which easily makes a person tired.

U.S. Pat. No. 4,348,821 discloses a shoe sole structure of which one portion supports the metatarsal of a wearer and has a central projection. The disclosed structure enables a wearer to lean the body balance to the front by slightly lifting the heel at the state where the tip of the shoe sole touches the ground centering the central projection. Thus, the shoe sole enables the wearer to run without difficulty and jump up with a strong propulsion. However, the wearer may lose the balance since the heel and tip shift backward and forward centering around the central projection, and thus, the wearer may feel an uneasiness, which is undesirable.

SUMMARY OF THE INVENTION

It is an object of the present invention to provide a shoe sole designed such that the wearer can assume an ideal posture when jogging, running or walking, and which can be worn safely.

To accomplish the above object, the present invention provides a shoe sole to be attached to the lower part of the upper of a shoe, the shoe sole comprising an inclined upper surface where a heel support portion is higher than a toe support portion, and having at least one cavity which contracts by the weight of the wearer on a heel portion.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

The embodiments of the present invention will be described below with reference to the accompanying drawings.

Figure 1:
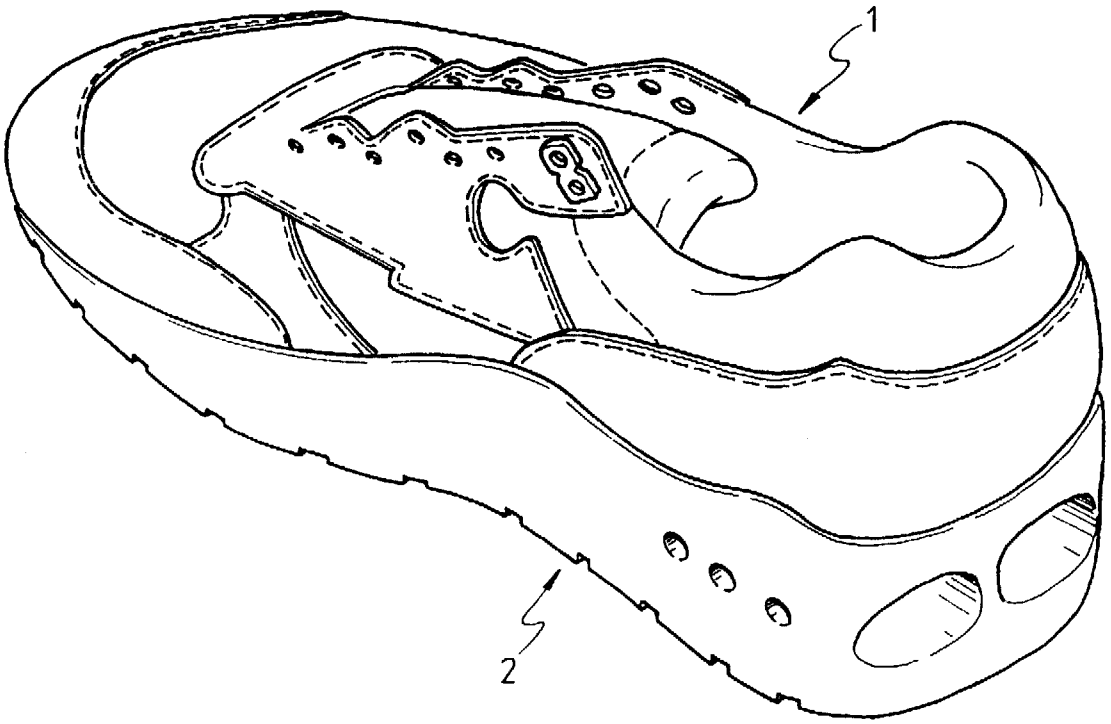
FIG. 1 is a perspective view of a shoe comprising a shoe sole according to a first embodiment of the present invention.

In FIG. 1, reference numeral 1 denotes a common shoe upper for protecting the instep of a wearer, and 2 denotes a shoe sole of the present invention.

Figure 2:
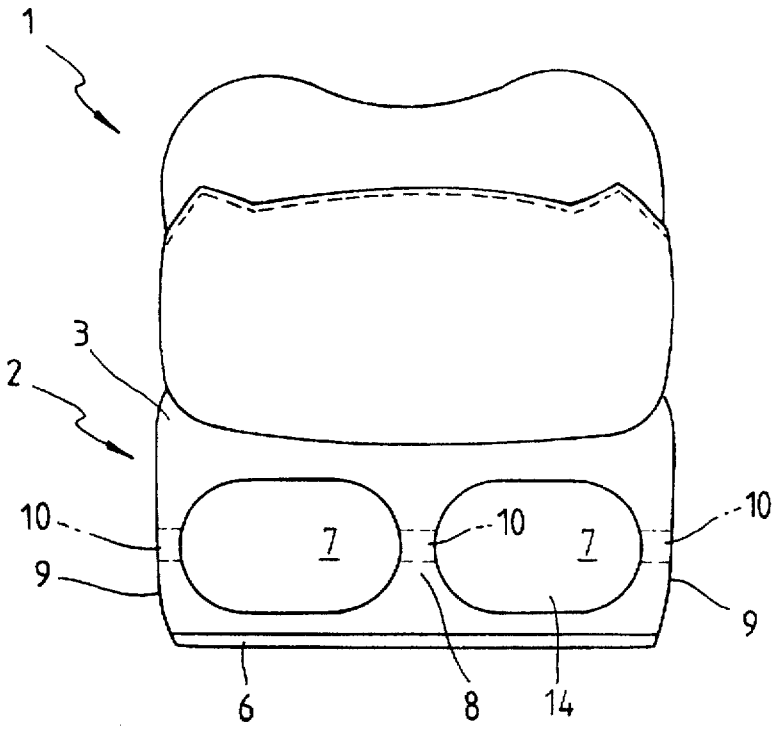
FIG. 2 is a rear view of the shoe shown in FIG. 1.
Figure 3:
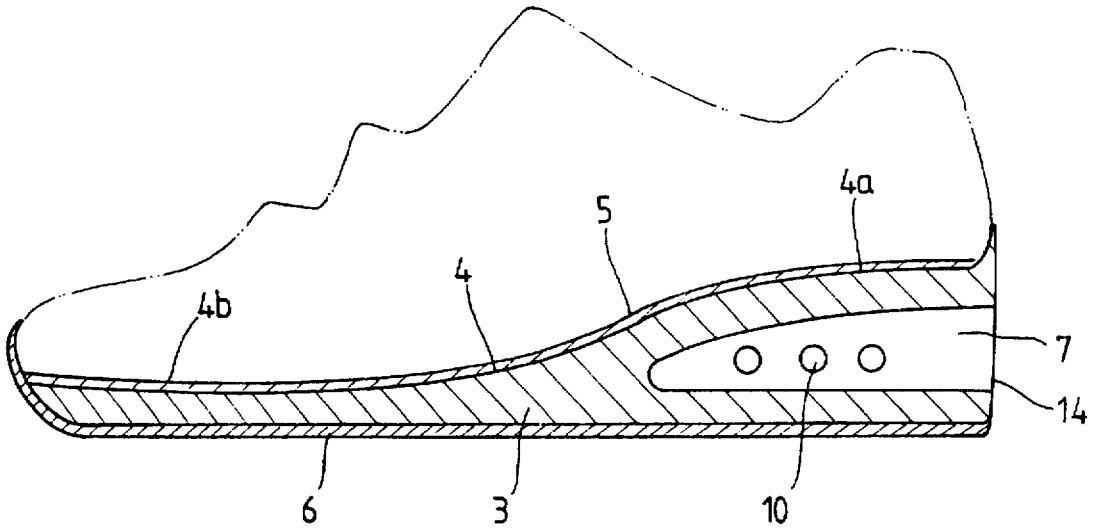
FIG. 3 is a longitudinal sectional view of the shoe sole FIG. 2.

Referring to FIGS. 2 and 3, shoe sole 2 comprises a shoe sole body 3 for maintaining the original form of the shoe sole, an upper surface member 5 for supporting the sole of a wearer's foot and which is glued to an upper surface 4 of shoe sole body 3, and a bottom member 6 for coming into contact with the ground and which is glued to a bottom surface of sole body 3. Upper surface 4 of shoe sole body 3 is bent smoothly such that a heel support part **4*a* for supporting the wearer's heel can be formed in a higher position than a toe support part 4*b* for supporting the toes. In addition, a cavity 7 being open at the rear thereof is formed inside the heel of shoe sole body 3. The cavity is defined by left and right walls 9 and a partition 8 for separating two cavities 7. Though two such cavities are shown in the drawings, any number is possible, and the cavity shape may vary as necessary. In this embodiment, one or more holes 10 are formed in partition 8 and walls 9 to communicate with cavity 7**. It may be no matter whether no hole is formed, if necessay.

Figure 4:
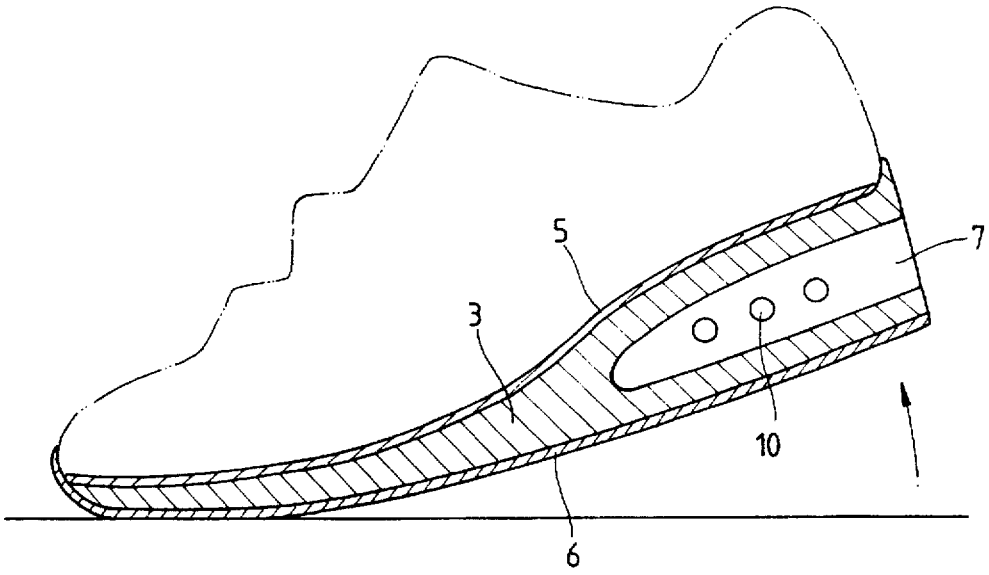
FIG. 4 is a side sectional view of a shoe sole according to the first embodiment of the present invention, showing the appearance thereof when a wearer runs.

To keep cavity 7 from contracting, the wearer must consciously lift his heels slightly so that the weight of the body may not rest rearward when wearing shoes having shoe sole 2. Here, the balance of the body naturally leans to the front, since an upper surface of shoe sole body 3 is inclined to the front. Accordingly, moving greatly the wearer's weight to the front by means of lifting the heel so as to change the state shown in FIG. 3 into the state shown in FIG. 4 when walking or running is made easy. Thus, less energy is needed.

Figure 5:
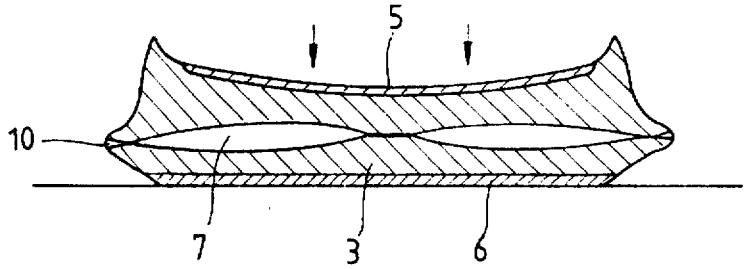
FIG. 5 is a rear transverse sectional view of a shoe sole according to the first embodiment of the present invention, showing the appearance thereof with the heel of the shoe sole being contracted.

FIG. 5 shows the state where cavity 7 is contracted when the weight of the wearer is loaded onto the heel of the foot. During the contraction of cavity 7, the heel of shoe sole body 3 serves as a cushion. Thus, an impact reflected from the ground is alleviated and the wearer promptly becomes accustomed to such contraction of cavity.

As the contraction of cavity 7 proceeds, air within cavity 7 is evacuated via an aperture 14 of the cavity, and holes 10 of partition 8 and walls 9. That is, the degree of contraction can be determined in proportion to the size and/or arrangement of cavity 7. In addition, the size and number of holes 10 and aperture 14 of cavity 7 are determined to suit the intended contracting speed of cavity 7.

Figure 6:
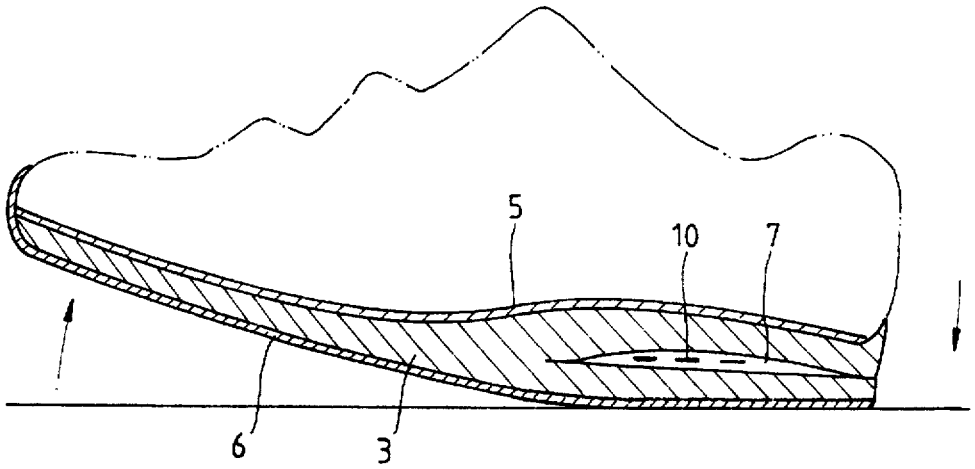
FIG. 6 is a side sectional view of a shoe sole according to the first embodiment of the present invention, showing the appearance thereof when a wearer lifts his toes to perform a stretching training with the heel of the shoe sole being contracted.

FIG. 6 is a side sectional view showing the appearance of the shoe sole when a wearer intentionally loads his weight onto the heel to lift the front of bottom member 6 from the ground so that cavity 7 remains in the contracted state. In such a position, the rear muscles of the lower extremities are stretched, thereby achieving a stretching effect. In this figure, the upper and lower surfaces of the interior of the cavity 7 are shown contacting each other.

Figure 7:
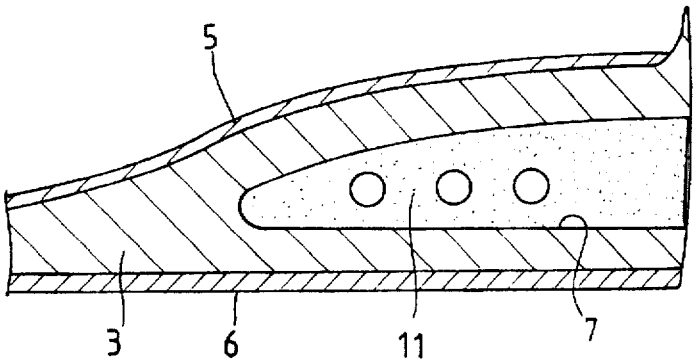
FIG. 7 is a side sectional view showing a part of a shoe sole according to a second embodiment of the present invention.
Figure 8:
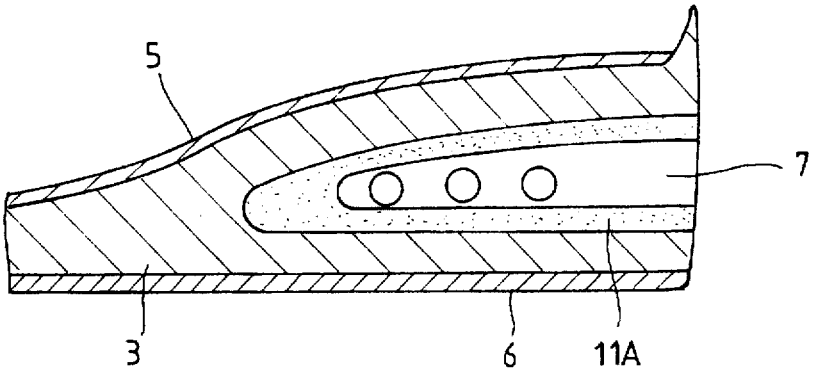
FIG. 8 is a side sectional view showing a part of a shoe sole according to a third embodiment of the present invention.
Figure 9:
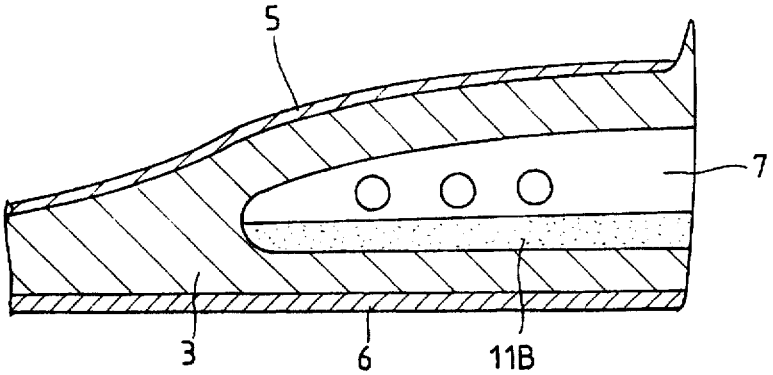
FIG. 9 is a side sectional view showing a part of a shoe sole according to a fourth embodiment of the present invention.

FIGS. 7, 8 and 9 illustrate various modifications of shoe soles according to second, third and fourth embodiments of the present invention, respectively. Here, impact absorption members 11, 11A and 11B, which may be of a sponge or sponge-like material, entirely or partially fill cavity 7 of shoe sole body 3. Impact absorption members 11, 11A and 11B lessen the degree and speed of contraction depending on the state when cavity 7 is contracted. Thus, the impact absorption members serve as a cushion which acts gradually with respect to a reflection impact from the ground, and thereby enabling an improved cushioning effect.

Figure 10:
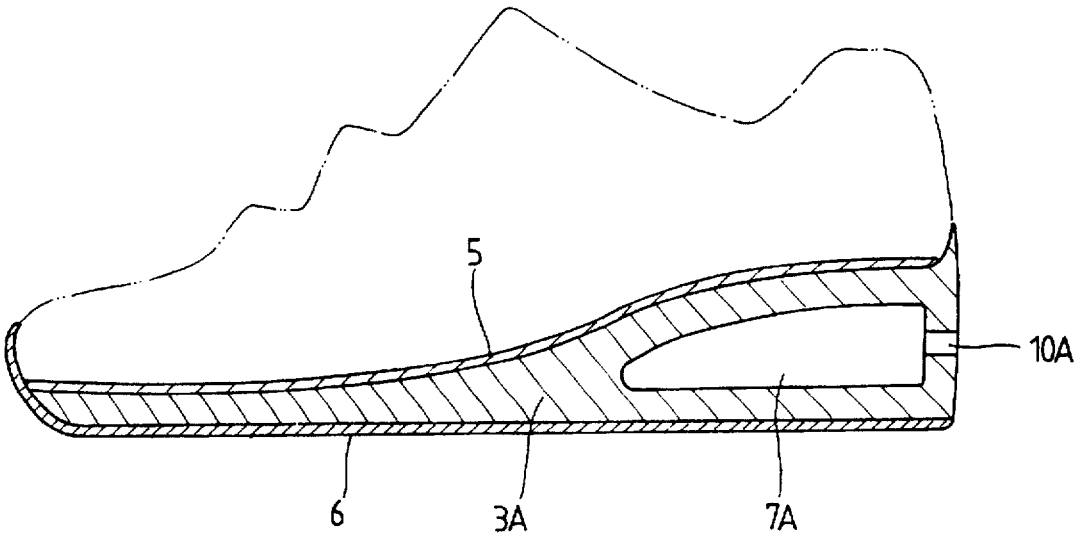
FIG. 10 is a side sectional view showing a shoe sole according to a fifth embodiment of the present invention.

FIG. 10 shows a shoe sole according to a fifth embodiment of the present invention. A shoe sole body 3A has a cavity 7A which is operated at both side walls of the heel, and small holes 10A in the rear portion.

Figure 11:
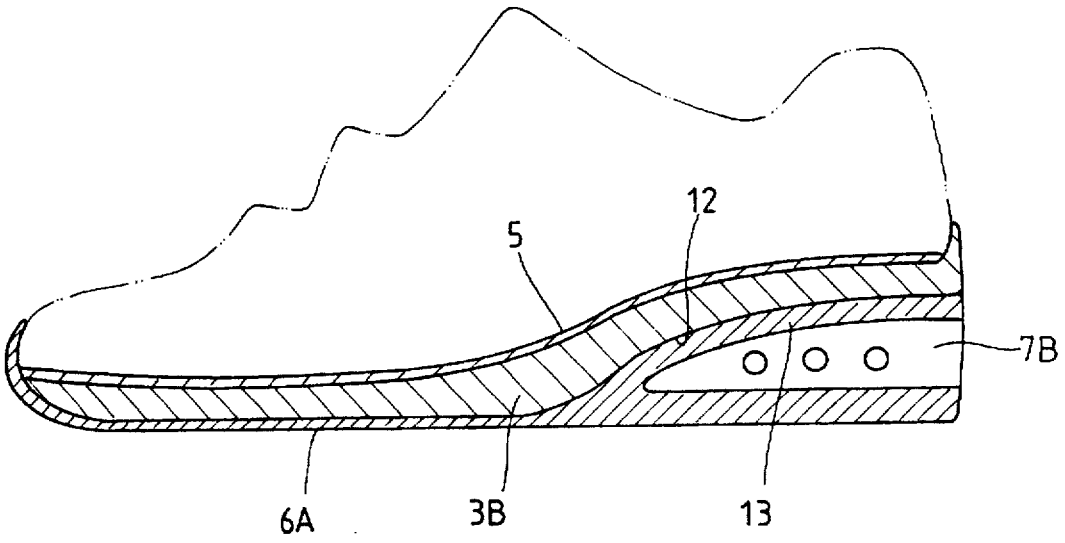
FIG. 11 is a side sectional view showing a shoe sole according to a sixth embodiment of the present invention.

FIG. 11 shows a shoe sole according to a sixth embodiment of the present invention. The shoe sole comprises the shoe sole body 3B and bottom member 6A shaped differently from that of the fifth embodiment. Shoe sole 3B is made of a relatively rigid material and has an arch 12 formed inwardly in the bottom surface of the rear portion thereof. Bottom member 6A is made of a pliable material, e.g., rubber, having highly frictional resistance properties, to guard against slipping. Bottom member 6A comprises a protrusion 13 formed to be tightly fitted to arch 12. In addition, cavity 7B which is contractible depending on the wearer's weight is provided in protrusion 13 as described above.

Impact absorption members 11, 11A and 11B may entirely or partially fill up cavities 7A and 7B of shoe soles of embodiments 3 and 4.

As described above, the present invention provides a shoe sole which enables a wearer to perform a training for improving the muscular strength of the lower extremities, when jogging, running or walking casually, to thereby contribute to health maintenance.

What is claimed is:

1. A shoe sole for attachment to a lower part of an upper of a shoe, the shoe sole comprising:

an inclined upper surface having a heel support portion and a toe support portion lower than the heel support portion; and a heel portion disposed beneath the heel support portion and having a plurality of contractible cavities formed therein, each cavity extending in a lengthwise direction of the heel portion and having a blind front end and a rear end having an opening which opens onto a rear surface of the heel portion, a plurality of outer passages for air, each outer passage communicating between a side surface of the heel portion and one of the cavities, and an internal passage for air interconnecting two of the cavities, the opening of each cavity having a larger area than each of the outer passages.

2. A shoe sole as claimed in claim 1 wherein each cavity is tapered from its rear end to its front end.

3. A shoe sole as claimed in claim 1 wherein the front end of each cavity is in a rear portion of the shoe sole.

4. A shoe sole as claimed in claim 1 further comprising an impact absorption member disposed in each cavity.

5. A shoe sole as claimed in claim 4, wherein each impact absorption member entirely fills the cavity in which it is disposed.

6. A shoe sole as claimed in claim 4, wherein each impact absorption member partially fills the cavity in which it is disposed.

7. A shoe sole as claimed in claim 1 comprising a shoe sole body including the upper surface and a bottom member for contacting the ground attached to a bottom surface of the shoe sole body, the cavities being formed in the bottom member.

8. A shoe sole as claimed in claim 7, further comprising an impact absorption member disposed in each cavity.

9. A shoe sole as claimed in claim 8, wherein each impact absorption member entirely fills the cavity in which it is disposed.

10. A shoe sole as claimed in claim 8, wherein each impact absorption member partially fills the cavity in which it is disposed.

11. A shoe sole as claimed in claim 7 wherein the shoe sole body has an arch in its bottom surface at a rear portion thereof, and the bottom member has a protrusion in a rear portion thereof having an upper surface complementary in shape to the arch, each cavity being formed in the protrusion beneath the arch.

12. A shoe sole as claimed in claim 1 comprising a shoe sole body including the inclined upper surface and a bottom member for contacting the ground attached to a bottom surface of the shoe sole body, each cavity being formed in the shoe sole body.

13. A shoe sole as claimed in claim 1 wherein an internal height of each cavity increases towards the rear of the heel portion.

14. A shoe sole as claimed in claim 4 wherein each impact absorption member comprises a lining on top and bottom surfaces of the cavity in which it is disposed.

15. A shoe sole as claimed in claim 4 wherein each impact absorption member comprises a lining formed on a bottom surface of the cavity in which it is disposed and a top surface of the cavity in which it is disposed is unlined.

16. A shoe sole as claimed in claim 1 wherein each cavity collapses substantially entirely in a vertical direction under the weight of a wearer of the shoe.

* * * * *